US009033761B2

(12) United States Patent
Azmani

(10) Patent No.: US 9,033,761 B2
(45) Date of Patent: May 19, 2015

(54) INTERACTIVE BUILDING BLOCK TOY

(76) Inventor: Youssef Azmani, Hales Corner, WI (US)

( * ) Notice: Subject to any disclaimer, the term of this patent is extended or adjusted under 35 U.S.C. 154(b) by 303 days.

(21) Appl. No.: 13/295,347

(22) Filed: Nov. 14, 2011

(65) Prior Publication Data

US 2012/0135665 A1 May 31, 2012

Related U.S. Application Data

(60) Provisional application No. 61/417,768, filed on Nov. 29, 2010.

(51) Int. Cl.
*A63H 33/08* (2006.01)
*A63H 33/12* (2006.01)
*A63H 33/10* (2006.01)

(52) U.S. Cl.
CPC ..... *A63H 33/105* (2013.01)

(58) Field of Classification Search
USPC ..... 446/85, 86, 108, 111, 112, 114–116, 446/119–122, 125–128; 52/585.1, 586.1, 52/586.2, 605
See application file for complete search history.

(56) References Cited

U.S. PATENT DOCUMENTS

| | | | | | |
|---|---|---|---|---|---|
| 1,281,856 | A * | 10/1918 | Shaw | 446/112 |
| 3,153,299 | A * | 10/1964 | Jennings | 446/127 |
| 3,791,090 | A * | 2/1974 | Kniefel | 52/590.2 |
| 4,833,856 | A * | 5/1989 | Zwagerman | 52/592.1 |
| 5,799,452 | A * | 9/1998 | Moore | 52/233 |
| 5,803,782 | A * | 9/1998 | Selton | 446/126 |
| 5,941,527 | A * | 8/1999 | Selton | 273/276 |
| 5,957,744 | A * | 9/1999 | Mott et al. | 446/127 |
| 6,874,291 | B1 * | 4/2005 | Weber | 52/586.1 |
| 7,340,868 | B2 * | 3/2008 | Weber | 52/586.1 |
| 2009/0215357 | A1 * | 8/2009 | Seligman | 446/127 |

* cited by examiner

*Primary Examiner* — Nini Legesse

(57) ABSTRACT

An interlocking toy block set may include at least two blocks with at least one constraining groove formed in a surface of each of the at least two blocks. At least one connector may have at least two attachment members formed thereon. The attachment members may have a cross-sectional shape corresponding to a cross-sectional shape of the constraining grooves.

10 Claims, 3 Drawing Sheets

INTERACTIVE BUILDING BLOCK TOY

RELATED APPLICATIONS

This application claims the benefit of U.S. Provisional Patent Application No. 61/417,768 filed on Nov. 29, 2010.

BACKGROUND OF THE INVENTION

The present invention generally relates to toy block sets and more particularly to interlocking sets of blocks.

It is well known that children may enjoy and benefit from making constructions with blocks. When making such a construction, a child may wish to move it from place to place. For example, if a child were to construct a simulated airplane, he or she may wish to pick up the completed construction and pretend that the simulated airplane is flying. If such a construction were to inadvertently fall apart, the child may become frustrated and the block set may soon be abandoned by the child.

In this context, it may be important that the block components of the construction remain attached to one another. It is also important that the child may be able to produce the construction without adult assistance and without a need to use tools for performing interconnection of the blocks.

As can be seen, there is a need for a system that allows an unassisted child to make interlocking block constructions which may remain reliably interconnected.

SUMMARY OF THE INVENTION

In one aspect of the present invention, a toy block set may comprise: at least two blocks with at least one constraining groove formed in a surface of each of the at least two blocks; and at least one connector having at least two attachment members formed thereon, the attachment members having a cross-sectional shape corresponding to a cross-sectional shape of the constraining grooves.

In another aspect of the present invention, a method for producing constructions with a toy block set may comprise the steps of: engaging a first attachment member of a connector with a constraining groove of a first block; and engaging a second attachment member of the connector with a constraining groove of a second block so the first and second blocks are held together by the connector.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide sets of toy blocks and connectors for reliably interconnecting the blocks with one another.

Figure 1:
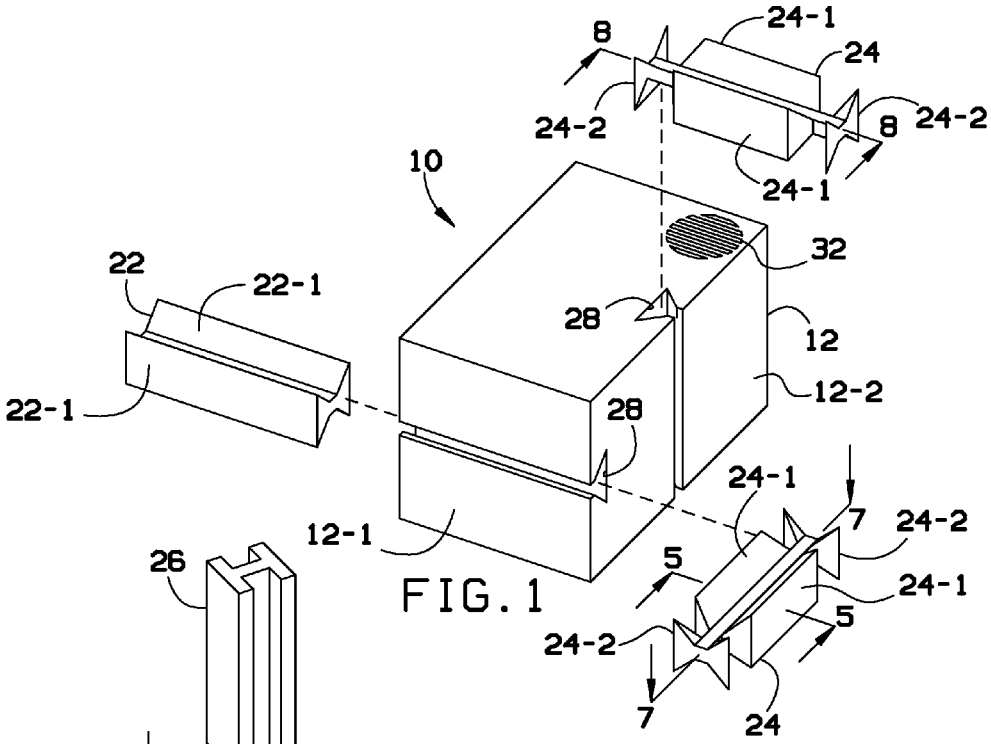
FIG. 1 is a perspective view of a toy block set in accordance with an embodiment of the invention.

Referring now to FIG. 1, it may be seen that an exemplary embodiment of a toy block set 10 may comprise blocks 12 and one or more connectors 22 and/or 24. Each of the blocks 12 may be provided with constraining grooves 28 formed in one or more of its surfaces. The grooves 28 may be oriented orthogonally to one another. For example in a first side 12-1 of the block 12, the groove 28 may be oriented horizontally, while in a second side 12-2 the groove 28 may be oriented vertically. Advantageously, some of the blocks 12 in the set 10 may have a rectilinear shape and may have grooves 28 in all of their sides. Alternatively, some of the blocks 12 in the set 10 may have any one of numerous non-rectilinear shapes e.g., semicircular or triangular.

The grooves 28 of the blocks 12 may have a dovetail shape. The connecters 22 may have corresponding dovetail-shaped attachment members 22-1 extending longitudinally along their length. The connectors 22 may be used to interconnect two of the blocks 12 by sliding a first one of the members 22-1 into a groove 28 of a first one of the blocks 12 and then sliding a second one of the members 22-1 into a groove 28 of a second one of the blocks 12.

Figure 2:
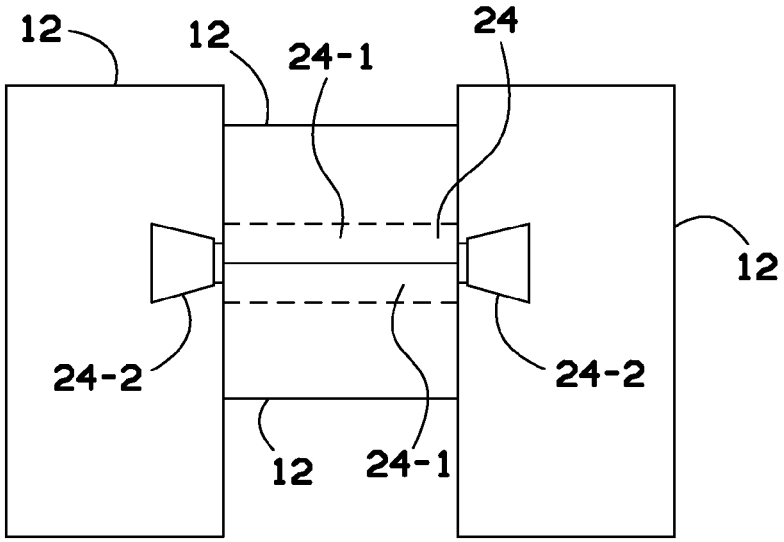
FIG. 2 is view of an operational feature of the toy block set of FIG. 1.

The connectors 24 may include dovetail-shaped attachment members 24-1 which may extend along a portion of the length of the connector 24. At one or more ends of the connector 24 there may be a dovetail-shaped engagement member 24-2. The engagement members 24-2 may be oriented orthogonally to the attachment members 24-1. The connectors 24 may be used to interconnect two or more of the blocks 12. As shown in FIG. 2, the connector 24 may have one of the attachment members 24-1 at each of its two ends. In this configuration, the connector 24 may be used to interconnect four of the blocks 12.

Figure 3:
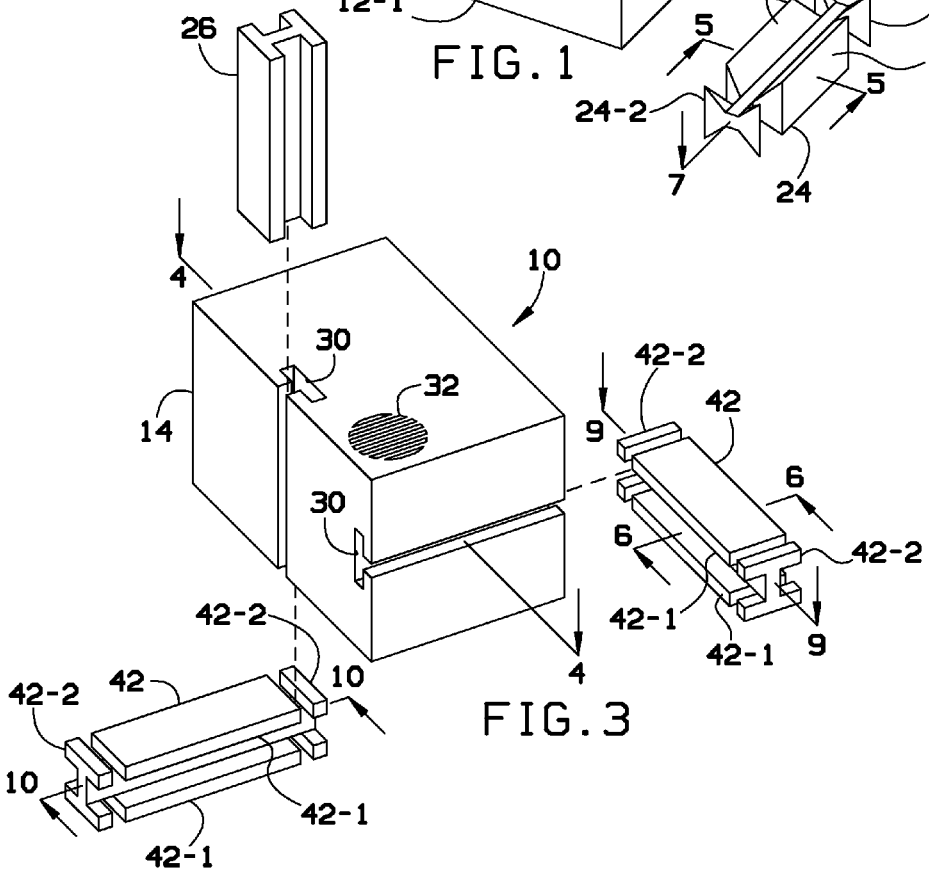
FIG. 3 is a perspective view of a toy block set in accordance with another embodiment of the invention.

Referring now to FIG. 3, it may seen that the set 10 may also comprise blocks 14 which may be interconnectable using connectors 26 and/or 42. The blocks 14 may include constraining grooves 30 which have a T-shaped cross-section. The connectors 26 may have attachment members 26-1 formed along their respective lengths. The attachment members 26-1 may have a T-shaped cross-section that may correspond to a shape of the groove 30. The connectors 42 may have attachment members 42-1 formed along portions of their respective lengths. The attachment members 42-1 may have a T-shaped cross-section that may correspond to a shape of the groove 30. The connectors 42 may also be provided with T-shaped engagement member 42-2 at one or more of their respective ends.

In a manner similar to that described above with respect to the blocks 12 and connectors 22 and 24, the blocks 14 may be interconnected with the connectors 26 and 42.

Figure 4:
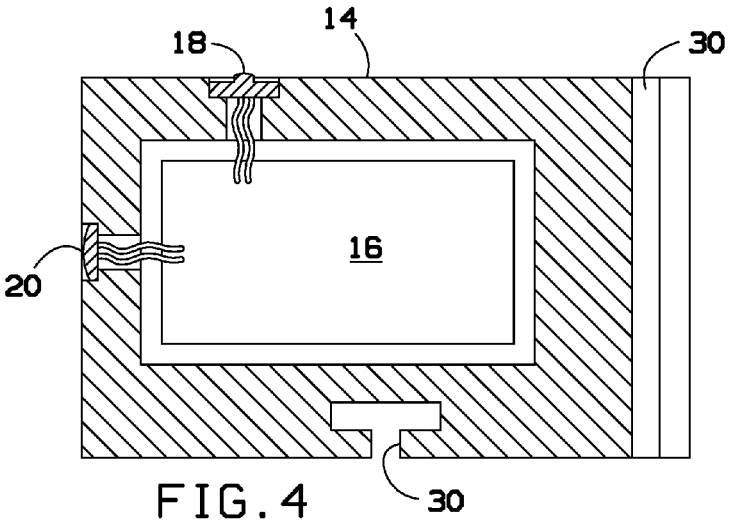
FIG. 4 is a cross-sectional view of a block of the set of FIG. 3.
Figure 5:
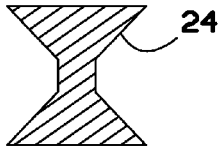
FIGS. 5 through 10 are cross-sectional views of connectors of FIGS. 1 and 3 in accordance with the invention.
Figure 6:
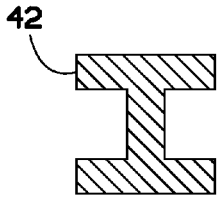
Figure 7:
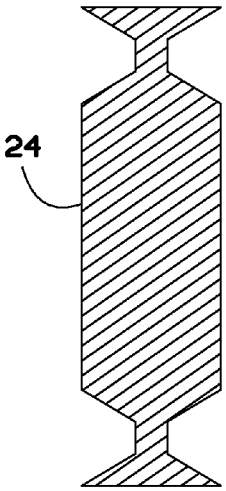
Figure 8:
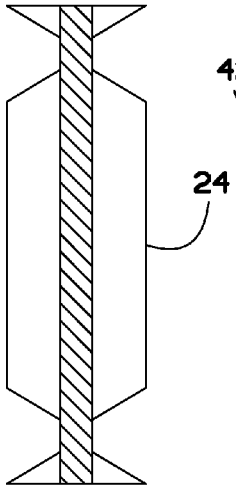
Figure 9:
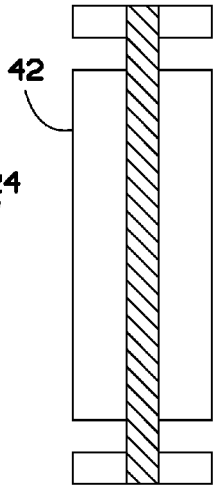
Figure 10:
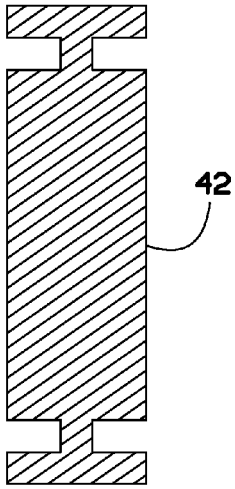
Figure 11:
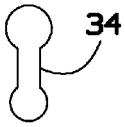
FIGS. 11 through 14 are alternate cross-sectional configurations of connectors in accordance with the invention.
Figure 12:
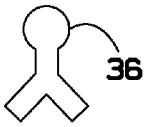
Figure 13:
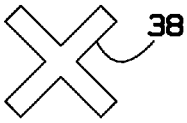
Figure 14:
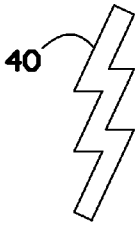

Referring now to FIG. 4, it may be seen that one or more of the blocks 12 or 14 may be provided with a sound producing device. For example, a sound producing chip and battery assembly 16 may be imbedded in one of the blocks 14. The block 14 may be provided with a speaker 32 (see FIGS. 1 and 3) and an on/off switch 20 and a pushbutton switch to activate the sound producing assembly 16.

While the blocks 12 and 14 are illustrated with dovetail-shaped grooves and T-shaped groove respectively, it may be noted that a combination of various other constraining grooves and corresponding connectors may be employed in the block set 10. Exemplary cross-sectional views of some alternative shapes are illustrated in FIGS. 11 through 14.

Figure 15:
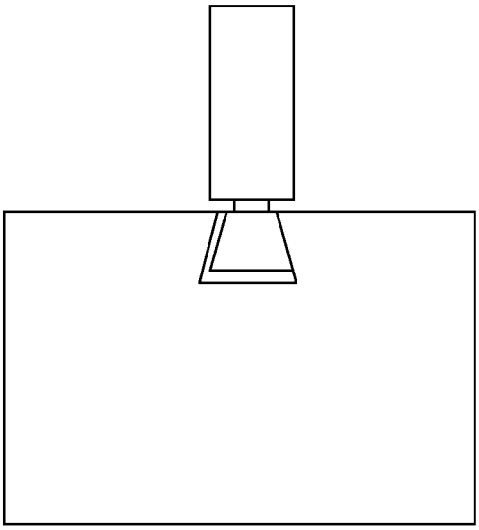
FIGS. 15 and 16 are elevation views of operational features of the block set of FIG. 1.
Figure 16:
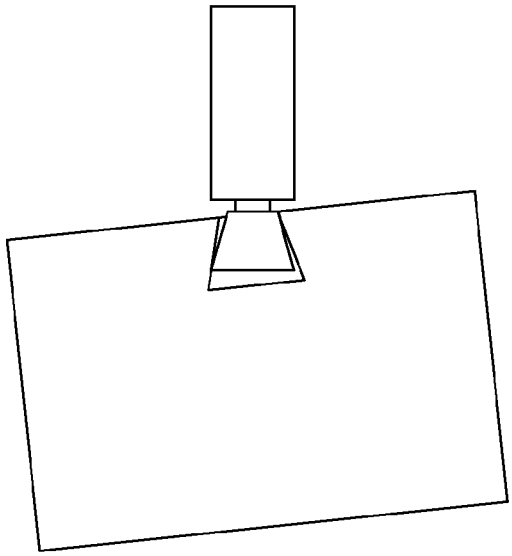

Referring now to FIGS. 15 and 16, it may be seen that the block set may be provided with a feature that allows for relative movement of one or more of the blocks and/or connectors. This feature may be implemented by making at least one of the connectors (e.g., connector 24) with an attachment member 24-2 smaller in cross-sectional area than that of a constraining grove 28 in the block 12. In such an arrangement the block may pivot on the connector 24.

It should be understood, of course, that the foregoing relates to exemplary embodiments of the invention and that modifications may be made without departing from the spirit and scope of the invention as set forth in the following claims.

What is claimed is:

1. A toy block set comprising:

at least two blocks with at least one constraining groove formed in a surface of each of the at least two blocks; and at least one connector having at least two attachment members formed thereon, the attachment members having a cross-sectional shape corresponding to a cross-sectional shape of the constraining grooves where multiple connectors have two attachment members extending along a portion of their lengths and have at least one engagement member at an end of the connectors, the engagement member being oriented orthogonally to the attachment members wherein multiple engagement members are smaller than the constraining groove such that the engagement members can move and pivot within the constraining groove.

2. The toy block set of claim 1 wherein the constraining groove is dovetail shaped.

3. The toy block set of claim 1 wherein the constraining groove is T shaped.

4. The toy block set of claim 1 wherein: at least one of the blocks is rectilinear; the at least one block has at least one of the grooves on a first one of its sides;

the at least one block has at least one of the grooves on a second one of its sides; and the groove on the first side is orthogonal to the groove on the second side.

5. The toy block set of claim 1 wherein at least one connector has two attachment members extending along its entire length.

6. The toy block set of claim 1 wherein the engagement member is smaller than the constraining groove such that it can move and pivot within the constraining groove.

7. A method for producing constructions with a toy block set comprising the steps of:

engaging a first attachment member of a connector with a constraining groove of a first block; and engaging a second attachment member of the connector with a constraining groove of a second block so the first and second blocks are held together by the connector engaging a third orthogonally oriented attachment member of the connector with a constraining groove of a third block so the first, second and third blocks are held together by the connector.

8. The method of claim 7 wherein the attachment members are slidably engaged with the constraining grooves.

9. A toy block set comprising:

at least two blocks with at least one constraining groove formed in a surface of each of the at least two blocks; and at least one connector having at least two attachment members formed thereon, the attachment members having a cross-sectional shape corresponding to a cross-sectional shape of the constraining grooves wherein at least one connector has two attachment members extending along a portion of its length and has at least one engagement member at an end of the connector, the engagement member being oriented orthogonally to the attachment members wherein a gap is located in between the attachment member and engagement member.

10. The toy block set of claim 9, wherein the orthogonal orientation begins at the gap that is located in between the attachment member and engagement member.

* * * * *